US007918697B2

(12) United States Patent
Gulas

(10) Patent No.: US 7,918,697 B2
(45) Date of Patent: Apr. 5, 2011

(54) WATERCRAFT AND METHOD FOR THE OPERATION OF A WATERCRAFT

(75) Inventor: Stefan Gulas, Nussdorf (AT)

(73) Assignee: Spinwood Trading & Consulting Ltd, Limassol (CY)

( * ) Notice: Subject to any disclaimer, the term of this patent is extended or adjusted under 35 U.S.C. 154(b) by 59 days.

(21) Appl. No.: 12/224,612

(22) PCT Filed: Mar. 1, 2007

(86) PCT No.: PCT/AT2007/000102

§ 371 (c)(1),
(2), (4) Date: Dec. 18, 2008

(87) PCT Pub. No.: WO2007/098518

PCT Pub. Date: Sep. 7, 2007

(65) Prior Publication Data

US 2009/0197485 A1 Aug. 6, 2009

(30) Foreign Application Priority Data

Mar. 2, 2006 (AT) ..... A 353/2006

(51) Int. Cl.
*B63H 16/04* (2006.01)

(52) U.S. Cl. ..... 440/101; 440/102; 440/104

(58) Field of Classification Search ..... 440/49, 440/51, 53, 101, 102, 104
See application file for complete search history.

(56) References Cited

U.S. PATENT DOCUMENTS

| | | | | |
|---|---|---|---|---|
| 827,202 | A * | 7/1906 | Bachman | 440/53 |
| 2,273,815 | A * | 2/1942 | Bevington | 440/28 |
| 3,498,253 | A * | 3/1970 | Wood, Jr. | 440/6 |
| 6,855,016 | B1 * | 2/2005 | Jansen | 440/6 |

FOREIGN PATENT DOCUMENTS

| | | |
|---|---|---|
| DE | 20316652 | 3/2004 |
| FR | 2332904 | 6/1977 |
| GB | 2403461 | 1/2005 |

OTHER PUBLICATIONS

English Abstract of DE 20316652.

* cited by examiner

*Primary Examiner* — Stephen Avila
(74) *Attorney, Agent, or Firm* — Dykema Gossett PLLC

(57) ABSTRACT

A watercraft (1) includes at least two oar handles (3*a*, 3*b*) which are designated to be actuated by a passenger of the watercraft in order to propel the same. A considerably expanded functionality is achieved in such a way that the oar handles (3*a*, 3*b*) are connected to a control unit which controls at least one power-actuated driving motor (6*a*, 6*b*; 7; 16*a*, 16*b*; 26*a*, 26*b*) of the watercraft depending on the actuation of the oar handles (3*a*, 3*b*).

4 Claims, 3 Drawing Sheets

WATERCRAFT AND METHOD FOR THE OPERATION OF A WATERCRAFT

BACKGROUND OF THE INVENTION

1. Field of the Invention

The invention relates to a method for the operation of a watercraft, and to a watercraft that includes at least two oar handles designated to be actuated by a passenger of the watercraft in order to propel the same.

"Oars" in connection with this invention are designated as the typical drive elements of a rowing boat which are identified in nautical language as boat oars. The term "actuation" shall be understood here as the typical rowing movement in conventional rowing boats which generate propulsion by a drawing movement on the oar handle while the blade of an oar is immersed.

2. The Prior Art

Muscle-driven watercraft are known which are arranged for example as rowing boats, paddleboats or the like. On the other hand, motor-driven watercraft such as electric boats are known which are driven via propellers, jet drives or the like. The control of these motor-driven motor vehicles usually occurs either directly through an outboard engine or via a control wheel in conjunction with a selector lever for the drive speed.

FR 2 332 904 A shows a boat that is driven by a person in the manner of a rowing boat via oar handles, with said oar handles not being in connection with the oars, but drive a propeller via a hydraulic mechanism. Furthermore, DE 203 16 652 U shows a boat drive in which drive fins can be actuated by a rowing-like motion. An auxiliary motor can be provided for amplification. Due to limitation to human muscle power, both concepts only allow for very limited drive performance, which also does not change when using an auxiliary motor because the same can only have a very low power in the case of direct coupling in the drive train when the actuation by the person should not be influenced in any undue manner.

It is the object of the present invention to provide a method for the operation of a watercraft and to provide a watercraft which is principally actuated like a rowing boat and provides the passenger with the drive feeling of a rowing boat, but which at the same time enables substantially higher drive speeds and offers the possibility to control the training effect for the user in a predetermined manner.

SUMMARY OF THE INVENTION

These objects are achieved in accordance with the invention in such a way that the oar handles are connected to a control unit which controls at least one power-actuated driving motor of the watercraft in accordance with the actuation of the oar handles. The relevant aspect in the present invention is that the oar handles are used primarily to provide a control unit with signals for the desired driving speed and driving direction.

A preferred embodiment of the invention provides that each oar handle separately triggers a driving motor. The driving motors are preferably laterally offset with respect to each other, so that a different actuation of the oar handles also leads to a different driving direction. In order to increase mobility, a rudder can additionally be provided which is triggered depending on the actuation of the oar handles.

The drive of the watercraft itself can be made on the one hand by oars, but it is also possible to provide a propeller or jet drive. When the watercraft is driven via oars, they can both be rigidly coupled with the oar handles and also partly or completely be uncoupled from the oar handles. In the latter case, drive is provided exclusively via the driving motor.

In order to precisely adjust the power to be provided by the passenger in relation to the driving speed, each oar handle can be connected with a generator or a braking device.

BRIEF DESCRIPTION OF THE DRAWINGS

The present invention will now explained in closer detail by reference to the embodiments shown in the drawings.

DETAILED DESCRIPTION OF THE PREFERRED EMBODIMENTS

Figure 1:
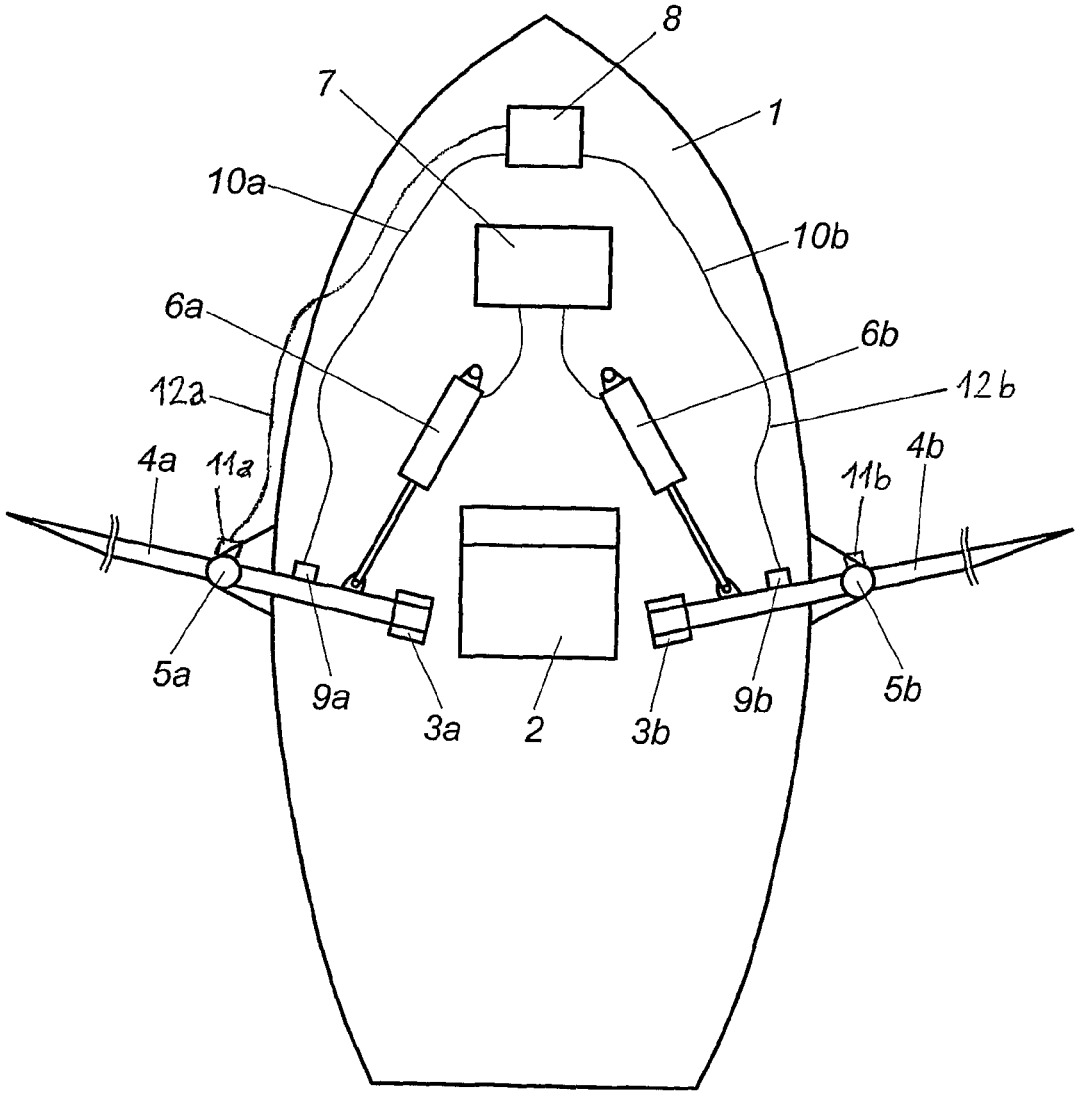
FIG. 1 shows a first embodiment of the invention.

FIG. 1 shows a watercraft generally designated with reference numeral 1 in the form of a rowing boat with a seat 2 for a passenger. It is obvious that in addition to this seat 2 further seats (not shown) can be provided which offer space for further users in order to arrange the boat in form of a coxed eight rowing boat for example.

Oar handles 3*a*, 3*b* are provided to the side of the seat 2, which handles are rigidly in connection with the oars 4*a*, 4*b* in this embodiment which are linked at points 5*a*, 5*b* to the rowing boat 1. Oars 4*a*, 4*b* are driven on the one hand via the oar handles 3*a*, 3*b* and on other hand via hydraulic cylinders 6*a*, 6*b* which represent the driving motors and are driven by a hydraulic unit 7. A control device 8 controls the hydraulic unit 7 and thus the hydraulic cylinders 6*a*, 6*b*.

Sensors 9*a*, 9*b* are connected with the oar handles 3*a*, 3*b* which detect the position of the oar handles 3*a*, 3*b* and send the same via control lines 10*a*, 10*b* to the control unit 8. Two further sensors 11*a* and 11*b* are attached to the joint points 5*a* and 5*b* which measure the joint pressure generated by rowing by the rower and send the same via control lines 12*a* and 12*b* to the control unit 8.

The embodiment of FIG. 1 represents a rowing boat with a servo drive, which means that although the actuation of the oars 4*a*, 4*b* principally occurs via the oar handles 3*a*, 3*b*, they are assisted via the driving motor 7; 6*a*, 6*b*, so that a considerably higher driving speed can be reached. The assist is proportional to the applied force, with the pressure in the sensors 11*a* and 11*b* being used as the control variable. The more force the rower provides himself, the stronger will he be assisted by the driving motor 7; 6*a*, 6*b*.

Figure 2:
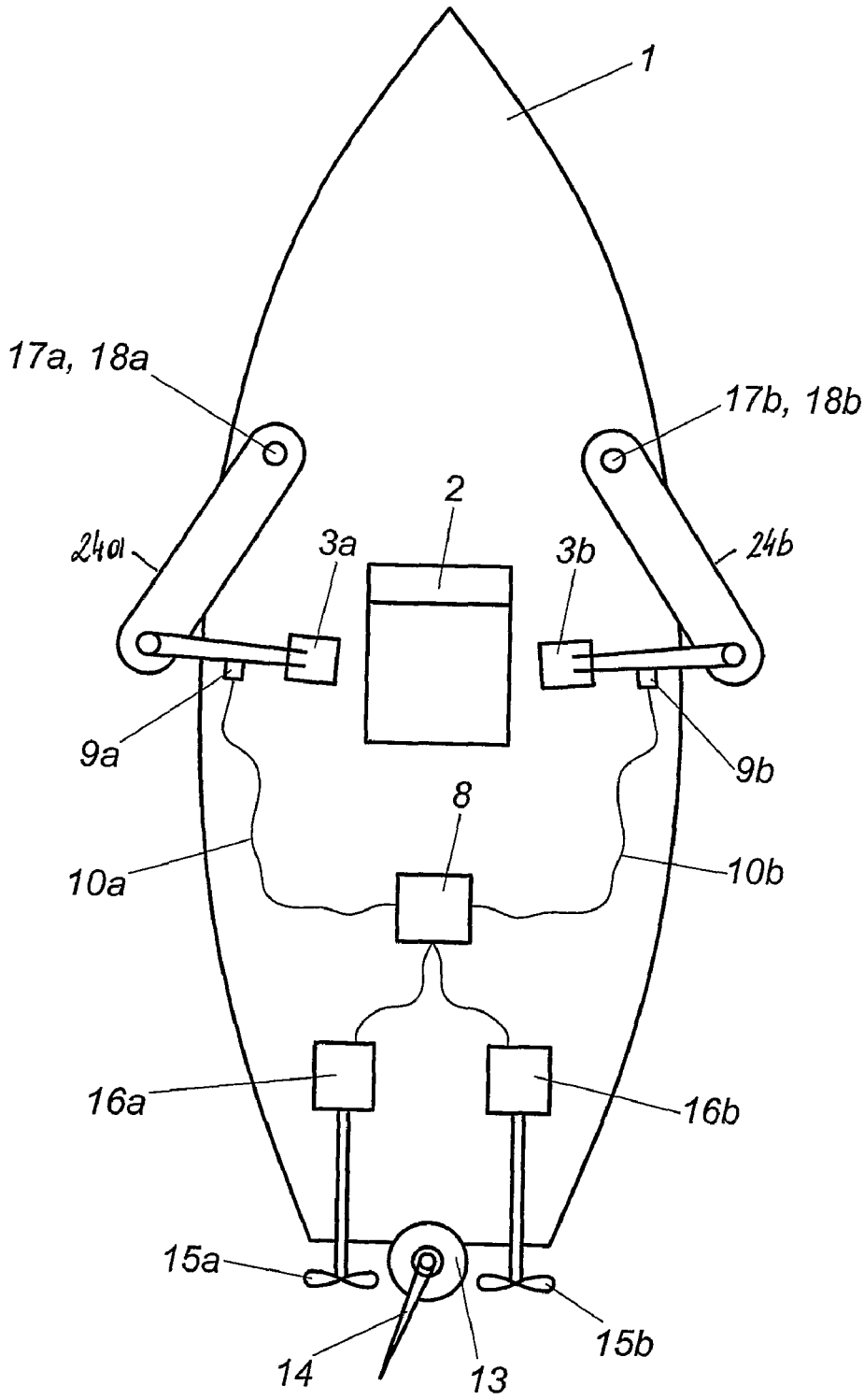
FIG. 2 shows a second embodiment of the invention.

In the embodiment according to FIG. 2, no oars are provided in contrast to that of FIG. 1, which means that the oar handles 3*a*, 3*b* are used exclusively for controlling the rowing boat 1. The rowing movement of the rower is preferably conducted to two generators 17*a* and 17*b* which are in connection with the handles 3*a*, 3*b* via belt drives 24*a*, 24*b* in order to offer respective resistance against the actuation of the oar handles 3*a*, 3*b*. Speed sensors 18*a* and 18*b* are built into the motor or belt drive in order to send the speed to the control device 8. It controls the drive motors 16*a*, 16*b* proportional to the speed of the generator attached to the same side.

In order to even out the drive power, a flywheel can also be connected with the generators or an electronic circuit can cause the evening. Software and hardware solutions can be used.

As an alternative to this, the position of the oar handles 3*a*, 3*b* can be detected by sensors 9*a*, 9*b* as in the first embodiment and be sent to a control device 8. It controls the driving motors 16*a*, 16*b* according to the actuation of the oar handles 3*a*, 3*b*, which on their part drive the propellers 15*a*, 15*b*.

The driving motors 16*a*, 16*b* can be arranged both as electric motors as well as internal combustion engines. In addition, a rudder 14 can be provided which is driven by a servo motor 13, which is also triggered by the control device 8.

Figure 3:
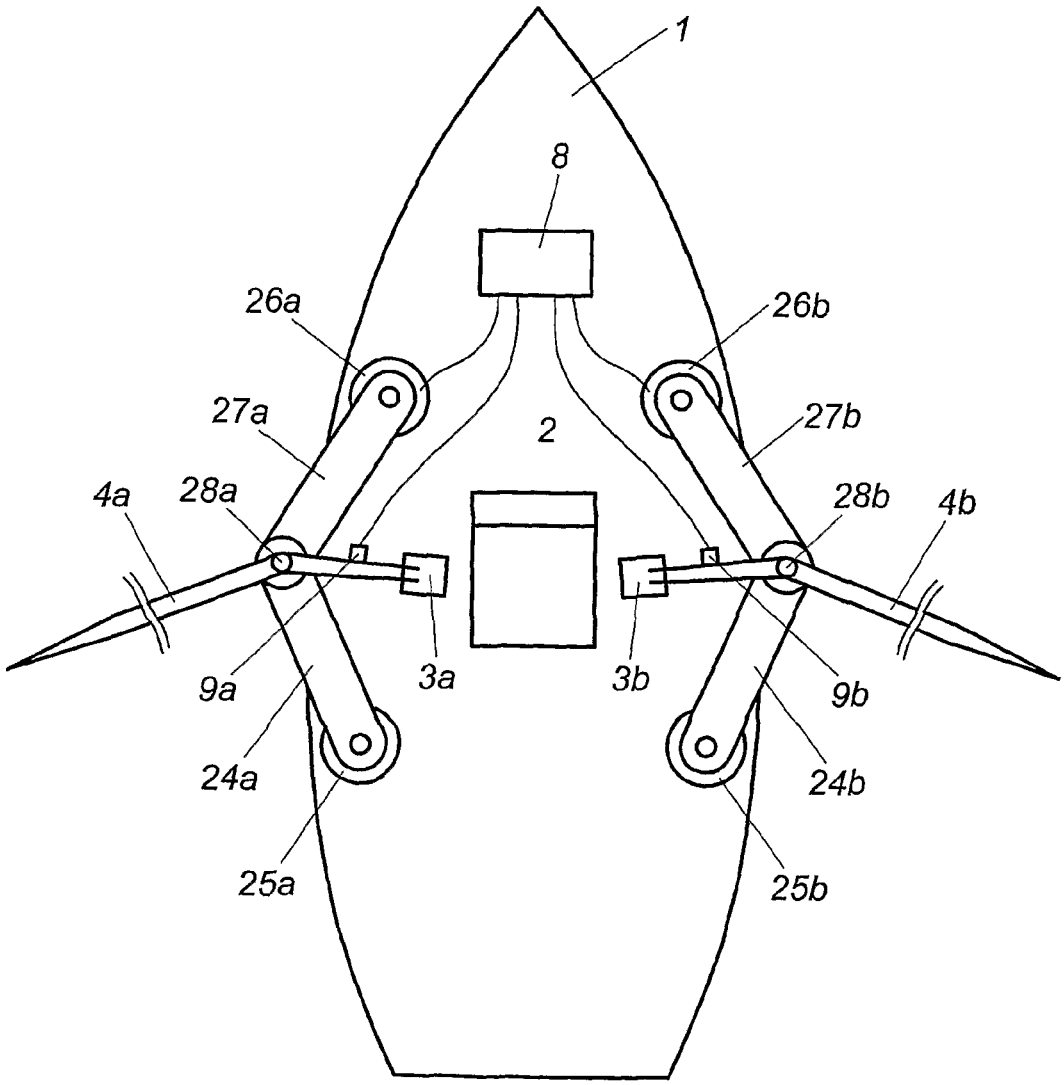
FIG. 3 shows a further embodiment in a schematic view.

The embodiment of FIG. 3 comprises oars 4*a*, 4*b* which are uncoupled from the oar handles 3*a*, 3*b*, in contrast to the embodiment of FIG. 1. Oars 4*a*, 4*b* are driven by driving motors 26*a*, 26*b* via drive belts 27*a*, 27*b* or via a hydraulic device (not shown) and lifted upwardly via lift motors 28*a* and 28*b* during the backstroke of the oar. The driving motors 26*a*, 26*b* are triggered by a control device 8, as in the above embodiments, and operated in equal cycle with the rowing motion of the rower.

The handles 3*a*, 3*b* are in connection with generators 25*a*, 25*b* via belt drives 24*a*, 24*b* in order to apply respective resistance against the actuation of the oar handles 3*a*, 3*b*. This resistance can be set by the control (oversteering) device 8 according to the driving state but also according to external requirements. This ensures predetermining a training program that offers the user of the watercraft a predeterminable training effect. The resistance can also be made dependent on the user's heart frequency if the same is measured.

The advantage of the embodiment of FIG. 3 is that the external appearance of the watercraft still corresponds to that of a rowing boat, but that unusually high driving speeds and/or rowing beats can be achieved.

The present invention allows creating a watercraft that offers functionality that is previously unheard of.

The invention claimed is:

1. A watercraft comprising at least two oar handles which are designated to be actuated by a passenger of the watercraft in order to propel the same, wherein the oar handles are connected to a control unit which controls at least one power-actuated driving motor of the watercraft depending on the actuation of the oar handles, wherein the oar handles are in connection with oars which influence the motion of the watercraft without the driving motor or in addition to the driving motor, and including an oversteering device which uncouples the motion of the oars at least partly from the motion of the oar handles and amplifies the same.

2. The watercraft according to claim 1, including a lifting device which lifts the uncoupled oars above the water during the backstroke of the oars.

3. The watercraft according to claim 1, wherein the oar handles are connected with hydraulic cylinders as working motors.

4. The watercraft according to claim 1, wherein the oar handles are in connection with a crank mechanism.

* * * * *